US011299797B2

(12) United States Patent
Wang et al.

(10) Patent No.: US 11,299,797 B2
(45) Date of Patent: Apr. 12, 2022

(54) COPPER-CONTAINING, HIGH-TOUGHNESS AND RAPIDLY DEGRADABLE MAGNESIUM ALLOY, PREPARATION METHOD THEREFOR AND USE THEREOF

(71) Applicant: CHONGQING UNIVERSITY, Chongqing (CN)

(72) Inventors: Jingfeng Wang, Chongqing (CN); Shiqing Gao, Chongqing (CN); Shijie Liu, Chongqing (CN); Kui Wang, Chongqing (CN); Fusheng Pan, Chongqing (CN)

(73) Assignee: CHONGQING UNIVERSITY, Chongqing (CN)

( * ) Notice: Subject to any disclaimer, the term of this patent is extended or adjusted under 35 U.S.C. 154(b) by 0 days.

(21) Appl. No.: 17/052,816

(22) PCT Filed: Jul. 1, 2019

(86) PCT No.: PCT/CN2019/094181

§ 371 (c)(1),
(2) Date: Nov. 4, 2020

(87) PCT Pub. No.: WO2020/082780

PCT Pub. Date: Apr. 30, 2020

(65) Prior Publication Data

US 2021/0269899 A1 Sep. 2, 2021

(30) Foreign Application Priority Data

Oct. 23, 2018 (CN) ..... 201811237128.4

(51) Int. Cl.

| | |
|---|---|
| ***C22C 23/06*** | (2006.01) |
| ***C22C 1/02*** | (2006.01) |
| ***C22C 1/04*** | (2006.01) |
| ***C22F 1/06*** | (2006.01) |

(52) U.S. Cl.

CPC ..... *C22C 23/06* (2013.01); *C22C 1/02* (2013.01); *C22C 1/04* (2013.01); *C22F 1/06* (2013.01)

(58) Field of Classification Search

CPC ... C22C 23/06; C22C 1/04; C22C 1/02; C22F 1/06

See application file for complete search history.

(56) References Cited

FOREIGN PATENT DOCUMENTS

| | | | |
|---|---|---|---|
| CN | 101805864 | A | 8/2010 |
| CN | 102051511 | A | 5/2011 |
| CN | 105568105 | A | 5/2016 |
| CN | 109161768 | A | 1/2019 |
| JP | H07278717 | A | 10/1995 |

*Primary Examiner* — Jessee R Roe

(74) *Attorney, Agent, or Firm* — MacMillan, Sobanski & Todd, LLC

(57) ABSTRACT

Provided are a copper-containing, high-toughness and rapidly degradable magnesium alloy, a preparation method therefor and the use thereof, wherein same relate to the field of materials for oil and gas exploitation. When the magnesium alloy is in an as-cast state, an extrusion state or an aging state, a strengthening phase thereof mainly includes an $Mg_{12}CuRE$-type long-period phase and an $Mg_5RE$ phase and an $Mg_2Cu$ phase, the $Mg_{12}CuRE$-type long-period phase has a volume fraction of 3-60%, the $Mg_5RE$ phase has a volume fraction of 0.5-20%, and the $Mg_2Cu$ phase has a volume fraction of 0.5-15%, wherein RE is a rare-earth metal element.

20 Claims, No Drawings

COPPER-CONTAINING, HIGH-TOUGHNESS AND RAPIDLY DEGRADABLE MAGNESIUM ALLOY, PREPARATION METHOD THEREFOR AND USE THEREOF

CROSS-REFERENCE TO RELATED APPLICATION

This application is a U.S. national application of the international application number PCT/CN2019/094181 filed on Jul. 1, 2019 and the present disclosure claims the priority to the Chinese patent application with the application number 201811237128.4 filed on Oct. 23, 2018 with the Chinese Patent Office, and entitled, "Copper-containing, High-toughness and Rapidly Degradable Magnesium Alloy, Preparation Method therefor and Use thereof", the contents of which are incorporated herein by reference in entirety.

TECHNICAL FIELD

The present disclosure relates to the field of materials for oil and gas exploitation, in particular to a copper-containing, high-strength and high-toughness, rapidly degradable magnesium alloy, a preparation method therefor and use thereof.

BACKGROUND ART

The fracturing technology is a core technology for developing oil and gas resources, and the fracturing ball is a key factor for determining whether staged fracturing is successful.

In the new technology of multi-stage sliding sleeve staged fracturing, the presence of fracturing balls mainly functions in two aspects: the first one is to open each stage of sliding sleeve, so as to fracture rock in each producing pay; and the second one is to isolate a fracturing liquid. Therefore, the fracturing ball has relatively high compression strength in the aqueous solution at room temperature, and can be kept stable during the oil and gas collection process, substantially without corrosion or decomposition. After the fracturing of rock in all producing pays is completed, the oil pipe in the oil well needs to be depressurized, so that later production of the oil and gas well can be facilitated. The previous conventional method is to remove the fracturing balls out of the wellhead using the pressure difference between the oil and gas layers and the oil pipe, but the fracturing balls may be clamped due to the factors of strata pressure and on-site construction pressure, resulting in unsuccessful removal; or to keep the wellbore unblocked by drilling, but this process will increase the construction period, and has very high requirements on the drilling tool, thereby greatly increasing the cost and risk. Therefore, a fracturing ball in an ideal state should be capable of withstanding high pressure and high temperature of the oil well during the fracturing construction, and can be controllably degraded in a fluid environment of an oil well, so as to dispense with the process of removing the fracturing balls, and further the construction cost and risk can be effectively reduced, the construction period is shortened, and the construction efficiency is improved.

However, in the current market, there is still a lack of a light-weight fracturing ball having properties of high strength and rapid corrosion, and it is of great significance to research and manufacture a fracturing ball having the above properties for the development of multi-stage staged fracturing technology, and the application in the field of oil and gas exploitation has a great prospect.

In view of this, the present disclosure is specifically proposed.

SUMMARY

An object of the present disclosure includes, for example, providing a copper-containing, high-strength and high-toughness, rapidly degradable magnesium alloy and a preparation method therefor, wherein a fracturing ball made using the magnesium alloy can solve the problems that the fracturing ball has low strength and is not easily degraded in the prior art.

An object of the present disclosure includes, for example, providing use of the above magnesium alloy in preparing a fracturing ball and use of the magnesium alloy in oil and gas exploitation, wherein the fracturing ball prepared using the above magnesium alloy has the advantages of high strength and rapid degradation, and using the fracturing ball prepared by the magnesium alloy in an oil and gas exploitation process can reduce the construction cost and risk, shorten the construction period, and improve the construction efficiency.

In order to achieve at least one of the above objects of the present disclosure, the following technical solution is specifically used.

A copper-containing, high-strength and high-toughness, rapidly degradable magnesium alloy, characterized in that a strengthening phase of the magnesium alloy mainly includes an $Mg_{12}CuRE$-type long-period stacking ordered phase, an $Mg_5RE$ phase and an $Mg_2Cu$ phase, the $Mg_{12}CuRE$-type long-period stacking ordered phase has a volume fraction of 3%-60%, the $Mg_5RE$ phase has a volume fraction of 0.5%-20%, and the $Mg_2Cu$ phase has a volume fraction of 0.5%-15%.

In the above, RE is a rare-earth metal element.

Optionally, the magnesium alloy includes as-cast magnesium alloy, as-homogenized magnesium alloy, as-extruded magnesium alloy and aged magnesium alloy.

Optionally, a strengthening phase of the as-cast magnesium alloy mainly includes an $Mg_{12}CuRE$-type long-period stacking ordered phase, an $Mg_5RE$ phase and an $Mg_2Cu$ phase, the $Mg_{12}CuRE$-type long-period stacking ordered phase has a volume fraction of 3%~55%, the $Mg_5RE$ phase has a volume fraction of 1%~15%, and the $Mg_2Cu$ phase has a volume fraction of 0.5%~8%.

Optionally, a strengthening phase of the as-extruded magnesium alloy mainly includes an $Mg_{12}CuRE$-type long-period stacking ordered phase, an $Mg_5RE$ phase and an $Mg_2Cu$ phase, the $Mg_{12}CuRE$-type long-period stacking ordered phase has a volume fraction of 4%~60%, the $Mg_5RE$ phase has a volume fraction of 2%~18%, and the $Mg_2Cu$ phase has a volume fraction of 1%~10%.

Optionally, a strengthening phase of the aged magnesium alloy mainly includes an $Mg_{12}CuRE$-type long-period stacking ordered phase, an $Mg_2Cu$ phase and an $Mg_xRE_y$ phase, the $Mg_{12}CuRE$-type long-period stacking ordered phase has a volume fraction of 4%~60%, the $Mg_2Cu$ phase has a volume fraction of 2%-15%, and the $Mg_xRE_y$ phase has a volume fraction of 3%~22%, wherein a value range of x:y is (3-12):1 (i.e., 3:1-12:1).

Optionally, RE is one or a combination of at least two of Gd, Y or Er.

Optionally, the volume fraction of the $Mg_{12}CuRE$-type long-period stacking ordered phase is, for example, 3%, 4.0%, 4.5%, 5.0%, 8%, 10%, 12%, 15%, 18%, 20%, 22%, 25%, 28%, 30%, 32%, 34%, 36%, 38%, 42%, 46%, 50%, 55%, 58% or 60%; the volume fraction of the $Mg_5RE$ phase may be, for example, 0.5%, 1%, 2%, 5%, 7%, 10%, 12%, 15%, 18% or 20%; the volume fraction of the $Mg_2Cu$ phase may be, for example, 0.5%, 1%, 2%, 3%, 5%, 6%, 8%, 9%, 10%, 12% or 15%.

Optionally, RE is Gd, Y, Er, a combination of Gd and Y, a combination of Gd and Er, a combination of Y and Er, or a combination of Gd, Y and Er.

Optionally, the $Mg_xRE_y$ may be, for example, $Mg_7RE$, $Mg_5RE$, $Mg_{12}RE$ or $Mg_{24}RE_5$. The volume fraction of the $Mg_xRE_y$ phase may be, for example, 3%, 5%, 7%, 10%, 12%, 15%, 18%, 20% or 22%.

Optionally, the magnesium alloy includes the following elemental composition in percentage by weight: Cu 1.0%-10%, and RE 1.0%-30%, and the balance includes Mg and unavoidable impurities.

Optionally, the magnesium alloy includes the following elemental composition in percentage by weight: Cu 1.0%~10%, RE 1.0%~30%, and M 0.03%~10%, and the balance includes Mg and unavoidable impurities.

In the above, M is an element that can be alloyed with magnesium.

Optionally, the magnesium alloy includes the following elemental composition in percentage by weight: Cu 1%~9%, and RE 1%~25%, and the balance includes Mg and unavoidable impurities.

Optionally, the magnesium alloy includes the following elemental composition in percentage by weight: Cu 2%~8%, and RE 2.5%~22%, and the balance includes Mg and unavoidable impurities.

Optionally, the magnesium alloy includes the following elemental composition in percentage by weight: Cu 1%~6.5%, RE 1%~28%, and M 0.1%~9%, and the balance includes Mg and unavoidable impurities, wherein M is an element that can be alloyed with magnesium.

Optionally, the magnesium alloy includes the following elemental composition in percentage by weight: Cu 2.0%~6.0%, RE 2.0%~22%, and M 0.1%~8.5%, and the balance includes Mg and unavoidable impurities, wherein M is an element that can be alloyed with magnesium.

Optionally, M is any one or a combination of at least two of Zn, Mn, Zr, V, Hf, Nb, Mo, Ti, Ca, Fe or Ni.

A method for preparing the above magnesium alloy, wherein raw materials are selected according to final phase composition of the magnesium alloy, to prepare the magnesium alloy.

Optionally, the raw materials are selected according to the elemental composition ratio of the magnesium alloy, and the magnesium alloy is prepared using an alloy preparation process.

Optionally, the alloy preparation process includes a smelting and casting method or a powder metallurgic method.

Optionally, the process step of the smelting and casting method includes: smelting the raw materials and then casting and shaping the smelted raw materials to obtain the magnesium alloy.

Optionally, the smelting process includes: melting the raw materials at 690~780° C., wherein an inert gas is adopted for protection during the melting process, after the raw materials are sufficiently melted, cooling the melted raw materials to 630~700° C., and standing for 20~90 min to complete the smelting.

Optionally, a magnesium alloy ingot is obtained by casting after the raw materials are smelted, and the magnesium alloy ingot is successively subjected to homogenization treatment and extrusion deformation, and then subjected to spherized molding treatment.

Optionally, a magnesium alloy ingot is obtained by casting after the raw materials are smelted, and the magnesium alloy ingot is successively subjected to homogenization treatment, extrusion deformation and aging heat treatment, and then subjected to spherized molding treatment.

Alternatively, the magnesium alloy ingot is successively subjected to homogenization treatment, extrusion deformation and spherized molding treatment, and then subjected to aging heat treatment.

Optionally, the homogenization treatment is performed in a process condition of: being kept at 350° C.~480° C. for 10 h~36 h.

Optionally, the extrusion deformation is performed in a process condition of: an extrusion temperature of 350° C.~470° C., and an extrusion ratio of 10~40.

Optionally, the condition of the aging heat treatment is: being kept at 150° C.~250° C. for 20 h~60 h.

Use of the above magnesium alloy in preparation of a fracturing ball.

Use of the above magnesium alloy in oil and gas exploitation.

Compared with the prior art, the present disclosure, for example, has following beneficial effects:

the copper-containing, high-strength and high-toughness, rapidly degradable magnesium alloy provided in the present disclosure takes magnesium as a base material, and by adding the rare-earth metal elements RE and Cu, the magnesium alloy material obtained forms the $Mg_{12}CuRE$-type long-period stacking ordered phase, the $Mg_5RE$ phase and the $Mg_2Cu$ phase, thereby significantly improving the mechanical properties such as strength of the magnesium alloy; the presence of a large amount of Cu-containing intermetallic compound microparticles, such as the $Mg_2Cu$ phase, and the $Mg_{12}CuRE$-type long-period stacking ordered phase, have a very large electronegativity difference with the magnesium matrix, and a large number of microbatteries are formed, then promoting the degradation of the magnesium alloy material.

The magnesium alloy provided in the present disclosure has been tested to have a tensile strength of up to 150-450 MPa, good elongation, and a corrosion rate of 300 mm/a-3000 mm/a in 3.5 wt. % sodium chloride solution at 93° C. It can be seen therefrom that the magnesium alloy provided in the present disclosure has the characteristics of high strength, high toughness and rapid degradation.

DETAILED DESCRIPTION OF EMBODIMENTS

Embodiments of the present disclosure will be described in detail below in connection with examples, while a person skilled in the art would understand that the following examples are merely used for illustrating the present disclosure, but should not be considered as limitation on the scope of the present disclosure. If no specific conditions are specified in the examples, they are carried out under normal conditions or conditions recommended by manufacturers. If manufacturers of reagents or apparatuses used are not specified, they are conventional products commercially available.

In one aspect, the present disclosure provides a copper-containing, high-strength and high-toughness, rapidly degradable magnesium alloy, wherein a strengthening phase of the magnesium alloy mainly includes an $Mg_{12}CuRE$-type long-period stacking ordered phase, an $Mg_5RE$ phase and an $Mg_2Cu$ phase, the $Mg_{12}CuRE$-type long-period stacking ordered phase has a volume fraction of 3%~60%, the $Mg_5RE$ phase has a volume fraction of 0.5%~20%, and the $Mg_2Cu$ phase has a volume fraction of 0.5%~15%.

In the above, RE is a rare-earth metal element.

The copper-containing, high-strength and high-toughness, rapidly degradable magnesium alloy provided in the present disclosure takes magnesium as a base material, and by adding the rare-earth metal elements RE and Cu, the magnesium alloy material obtained forms the $Mg_{12}CuRE$-type long-period stacking ordered phase, the $Mg_5RE$ phase and the $Mg_2Cu$ phase, thereby significantly improving the mechanical properties such as strength of the magnesium alloy; the presence of a large amount of Cu-containing intermetallic compound microparticles, such as the $Mg_2Cu$ phase, and the $Mg_{12}CuRE$-type long-period stacking ordered phase, have a very large electronegativity difference with the magnesium matrix, and a large number of micro-batteries are formed, then promoting the degradation of the magnesium alloy material.

The magnesium alloy provided in the present disclosure has been tested to have a tensile strength of up to 150-450 MPa, good plasticity, and a corrosion rate of 300 mm/a-3000 mm/a in 3.5 wt. % sodium chloride solution at 93° C. It can be seen therefrom that the magnesium alloy provided in the present disclosure has the characteristics of high strength, high toughness and rapid degradation.

In the present disclosure, the long-period stacking ordered structure is called as long-period structure for short, and the $Mg_{12}CuRE$-type long-period stacking ordered phase is a new strengthening phase in the magnesium alloy, and the $Mg_{12}CuRE$-type long-period stacking ordered phase can enhance the mechanical properties of the magnesium alloy at room temperature and high temperature. The $Mg_{12}CuRE$-type long-period stacking ordered phase of a specific proportion in the present disclosure can significantly improve the strength and plasticity of the magnesium alloy, and the degradation rate of the magnesium alloy can be improved through cooperation of the $Mg_{12}CuRE$-type long-period stacking ordered phase with the copper-containing intermetallic compound.

Cu is an important element that improves the solubility of alloy or increases the degradation rate. Copper is slightly dissolved in magnesium, and often forms a metal compound phase with magnesium to be distributed at the grain boundary, which is helpful to increase the degradation rate of magnesium, and is helpful to improve the mechanical properties of the alloy at high temperature. Copper can greatly accelerate the degradation rate of magnesium, and when the content reaches a critical value of ease of solubility or rapid degradation, the degradation rate of magnesium is particularly increased significantly. The higher the content is, the higher the degradation rate is, but too high content is unfavorable to controlling the alloy density and the cost, and besides, the mechanical properties of the alloy will be negatively affected.

In the present disclosure, the volume fraction of the $Mg_{12}CuRE$-type long-period stacking ordered phase is, for example, 3%, 4.0%, 4.5%, 5.0%, 8%, 10%, 12%, 15%, 18%, 20%, 22%, 25%, 28%, 30%, 32%, 34%, 36%, 38%, 42%, 46%, 50%, 55%, 58% or 60%; the volume fraction of the $Mg_5RE$ phase may be, for example, 0.5%, 1%, 2%, 5%, 7%, 10%, 12%, 15%, 18% or 20%; the volume fraction of the $Mg_2Cu$ phase may be, for example, 0.5%, 1%, 2%, 3%, 5%, 6%, 8%, 9%, 10%, 12% or 15%.

In the present disclosure, the rare-earth metal element RE may be, for example, one or a combination of at least two of Gd, Y or Er. For example, RE is Gd, Y, Er, a combination of Gd and Y, a combination of Gd and Er, a combination of Y and Er, or a combination of Gd, Y and Er.

In some optional embodiments of the present disclosure, the magnesium alloy includes as-cast magnesium alloy, as-homogenized magnesium alloy, as-extruded magnesium alloy and aged magnesium alloy.

In the as-cast magnesium alloy, a strengthening phase mainly includes an $Mg_{12}CuRE$-type long-period stacking ordered phase, an $Mg_5RE$ phase and an $Mg_2Cu$ phase, the $Mg_{12}CuRE$-type long-period stacking ordered phase has a volume fraction of 3%~55%, the $Mg_5RE$ phase has a volume fraction of 1%~15%, and the $Mg_2Cu$ phase has a volume fraction of 0.5%~8%.

In the as-extruded magnesium alloy, a strengthening phase mainly includes an $Mg_{12}CuRE$-type long-period stacking ordered phase, an $Mg_5RE$ phase and an $Mg_2Cu$ phase, the $Mg_{12}CuRE$-type long-period stacking ordered phase has a volume fraction of 4%~60%, the $Mg_5RE$ phase has a volume fraction of 2%~18%, and the $Mg_2Cu$ phase has a volume fraction of 1%~10%.

In the aged magnesium alloy, a strengthening phase mainly includes an $Mg_{12}CuRE$-type long-period stacking ordered phase, an $Mg_2Cu$ phase and an $Mg_xRE_y$ phase, the $Mg_{12}CuRE$-type long-period stacking ordered phase has a volume fraction of 4%~60%, the $Mg_2Cu$ phase has a volume fraction of 2%~15%, and the $Mg_xRE_y$ phase has a volume fraction of 3%~22%, wherein a value range of x:y is (3-12):1, $Mg_xRE_y$ may be, for example, $Mg_5RE$, $Mg_5RE$, $Mg_{12}RE$ or $Mg_{24}RE_5$. The volume fraction of the $Mg_xRE_y$ phase may be, for example, 3%, 5%, 7%, 10%, 12%, 15%, 18%, 20% or 22%.

In some embodiments of the present disclosure, the magnesium alloy includes the following elemental composition in percentage by weight: Cu 1.0%~10%, and RE 1.0%~30%, and the balance includes Mg and unavoidable impurities.

In further optional embodiments of the present disclosure, the magnesium alloy includes the following elemental composition in percentage by weight: Cu 1%~9%, and RE 1%~25%, and the balance includes Mg and unavoidable impurities.

In further optional embodiments of the present disclosure, the magnesium alloy includes the following elemental composition in percentage by weight: Cu 2%~8%, and RE 2.5%~22%, and the balance includes Mg and unavoidable impurities.

The magnesium alloy with the above microstructure can be obtained by using the element composition of the above ratio. That is, the volume fraction of the $Mg_{12}CuRE$-type long-period stacking ordered phase is 3%~60%, the volume fraction of the $Mg_5RE$ phase is 0.5%~20%, and the volume fraction of the $Mg_2Cu$ phase is 0.5%~15%.

In some embodiments of the present disclosure, the magnesium alloy includes the following elemental composition in percentage by weight: Cu 1.0%~10%, RE 1.0%~30%, and M 0.03%~10%, and the balance includes Mg and unavoidable impurities, wherein M is an element that can be alloyed with magnesium.

In further optional embodiments of the present disclosure, the magnesium alloy includes the following elemental composition in percentage by weight: Cu 1%~6.5%, RE 1%~28%, and M 0.1%~9%, and the balance includes Mg and unavoidable impurities, wherein M is an element that can be alloyed with magnesium.

In yet further optional embodiments of the present disclosure, the magnesium alloy includes the following elemental composition in percentage by weight: Cu 2.0%~6.0%, RE 2.0%~22%, and M 0.1%~8.5%, and the balance includes Mg and unavoidable impurities, wherein M is an element that can be alloyed with magnesium.

The addition of an element capable of being alloyed with magnesium can further improve the performance of the magnesium alloy in a certain aspect. For example, M is any one or a combination of at least two of Zn, Mn, Zr, V, Hf, Nb, Mo, Ti, Ca, Fe or Ni.

Zn has a good solid solution strengthening effect, the addition of Zn can form an Mg—Zn eutectic phase in the magnesium alloy, and the eutectic phase has a good dispersion strengthening effect.

Mn, Zr, V, Hf, Nb, Mo, Ti or Ca mainly functions to refine the crystalline grains, wherein both Zr and Mn elements are elements which do not form a second phase with Mg, and are present in the alloy in a form of particles. Ca and Mg form an $Mg_2Ca$ phase more easily, which can provide a large amount of nucleation particles in the process of solidification and thermal deformation, thereby obviously refining the crystalline grains. The strengthening effect of the elements such as V, Hf, Nb, Mo, and Ti is mainly embodied in that they can suppress the growth of the crystalline grains and the second phase in the extrusion process.

On one hand, Ni improves the solubility of alloy or increases the degradation rate, and in addition, mixed addition of Ni with rare-earth elements such as Y, Gd and Er will also introduce an $Mg_{12}CuRE$-type long-period stacking ordered phase to the alloy, and thus improve the plasticity and strength of the alloy. As a heavy metal element, Fe is an important alloy element which is indispensable or inevitable in an alloy formulation, and it functions to improve the alloy solubility or increase the degradation rate.

In some embodiments of the present disclosure, the copper-containing, high-strength and high-toughness, rapidly degradable magnesium alloy may be, for example, an Mg—Cu—Y-based alloy, a Mg—Cu—Er-based alloy, a Mg—Cu—Gd-based alloy or a Mg—Cu—Y—Er—Gd-based alloy.

A certain proportion of Zn, Mn, Fe, or Ni may be selectively added to each of the above series of alloys, so as to further improve the strength, plasticity or degradability of the alloy.

Taking the Mg—Cu—Y—Er—Gd-based alloy as an example, the addition of Gd, on one hand, aims at achieving the effect of strengthening precipitation, and on the other hand, it is added with Cu in mixture, which can introduce the $Mg_{12}CuRE$-type long-period stacking ordered phase to the alloy, and thus can comprehensively improve the plasticity and strength of the alloy. The addition of Er can promote the dynamic recrystallization process of the alloy during the deformation process, and meanwhile, as the presence of particles of the second phase suppresses the recrystallization growth, the size of the crystalline grains of the alloy is obviously refined. Moreover, the addition of Er and Cu in mixture can introduce the $Mg_{12}CuRE$-type long-period stacking ordered phase to the alloy, and can comprehensively improve the plasticity and strength of the alloy. In addition, the lattice distortion caused by the increased solid solution concentration of Er in the matrix promotes non-basal slip, weakens the basal texture, and thus can improve the alloy plasticity.

Taking the Mg—Cu—Y—Ni alloy as an example, in the Mg—Cu—Y—Ni alloy, on one hand, Ni improves the solubility of alloy or increases the degradation rate, and besides, the addition of Ni and Y elements in mixture can introduce the $Mg_{12}CuRE$-type long-period stacking ordered phase to the alloy, and improve the plasticity and strength of the alloy. The magnesium alloy has the characteristics of small density, high specific strength and high specific stiffness, good damping performance and electromagnetic shielding performance, a high corrosion rate, facilitating machining and so on, and the comprehensive performance meets the basic requirements of fracturing ball.

In another aspect, the present disclosure provides a method for preparing a magnesium alloy, wherein raw materials are selected according to final phase composition of the magnesium alloy, to prepare the magnesium alloy.

The magnesium alloy has all of the advantages of the above magnesium alloy, and unnecessary details will not be given herein.

In some embodiments of the present disclosure, the raw materials are selected according to the elemental composition ratio of the above magnesium alloy, and the magnesium alloy is prepared using an alloy preparation process.

In the above, the raw materials may be, for example, magnesium-yttrium alloy, magnesium-gadolinium alloy, magnesium-erbium alloy or nickel-yttrium alloy. In the above raw materials, as Gd, Er, Y, Ni or Mg is provided in a form of intermediate alloy, at this time, the ratio can be calculated according to the element content of each kind of intermediate alloy. Selecting the magnesium-yttrium alloy, magnesium-gadolinium alloy, magnesium-erbium alloy or nickel-yttrium alloy as raw material can reduce the processing temperature, prevent the problem of poor quality of solution due to inconsistent melting temperatures among different element materials, and further improve the melting quality and the processing efficiency. Cu and Fe may be added in a form of intermediate alloy or in a form of elemental copper and elemental iron, and the addition forms of Cu and Fe are not specifically limited in the present disclosure.

In some embodiments of the present disclosure, the alloy preparation process includes a smelting and casting method or a powder metallurgic method. In the present disclosure, the preparation process of the alloy is not specifically limited, for example, a smelting and casting method may be used, a powder metallurgic method also may be used, or the alloy is manufactured by a method of pressure processing and molding after casting.

In some embodiments of the present disclosure, the magnesium alloy is processed using a smelting and casting method, wherein the process step of the smelting and casting method includes: smelting the raw materials and then casting and shaping the smelted raw materials to obtain the magnesium alloy. For example, the following smelting process may be adopted: melting the raw materials at 690~780° C., wherein an inert gas is adopted for protection during the melting process, after the raw materials are sufficiently melted, cooling the melted raw materials to 630~700° C., and standing for 20~90 min to complete the smelting; optionally, melting the raw materials at 710~770° C., wherein an inert gas is adopted for protection during the melting process, after the raw materials are sufficiently melted, cooling the melted raw materials to 640~680° C., and standing for 30~60 min to complete the smelting.

A magnesium alloy ingot is obtained by casting after the raw materials are smelted, and the magnesium alloy ingot is successively subjected to homogenization treatment and extrusion deformation, and then subjected to spherized molding treatment.

Alternatively, a magnesium alloy ingot is obtained by casting after the raw materials are smelted, and the magnesium alloy ingot is successively subjected to homogenization treatment, extrusion deformation and aging heat treatment, and then subjected to spherized molding treatment.

Alternatively, the magnesium alloy ingot is successively subjected to homogenization treatment, extrusion deformation and spherized molding treatment, and then subjected to aging heat treatment.

In the above, the homogenization treatment may be performed in a process condition of: being kept at 350° C.~480° C. for 10 h~36 h; optionally, being kept at 360° C.~450° C. for 12 h~24 h; the extrusion deformation, for example, may be performed in a process condition of: an extrusion temperature of 350° C.~470° C., and an extrusion ratio of 10~40; optionally, the extrusion temperature is 380° C.~450° C., and the extrusion ratio is 10~28; and the condition of the aging heat treatment may be: being kept at 150° C.~250° C. for 20 h~60 h, optionally, being kept at 170° C.~220° C. for 25 h~50 h.

After ingot casting, the heterogeneity of the alloy ingot in chemical composition and structure can be improved through the homogenization treatment, the problems of segregation and enrichment of elements in a certain part occurring during crystallization are eliminated, such that various properties of the alloy material are more consistent, and thus the process plasticity thereof is improved.

By performing the extrusion and deformation treatment, defects such as holes in the alloy ingot can be eliminated, so that the alloy ingot is denser, and the crystalline grains are refined, thereby the strength of the alloy ingot can be further improved.

In the above embodiments, the aging heat treatment may be selectively performed, and the aging heat treatment may not be performed when the rare earth content is relatively low and the aging effect of the alloy is not obvious. Through the aging heat treatment, precipitation of the second phase such as the $Mg_5RE$ phase and the $Mg_2Cu$ phase can be promoted, internal stress of the alloy ingot or the magnesium alloy can be further improved, then stabilizing the structure and size, and further improving the strength of the alloy ingot or the magnesium alloy.

From the above analysis, it can be seen that the phase composition and topography of the alloy are adjusted and controlled by adopting raw material composition with a specific ratio and performing the smelting, extrusion deformation and aging heat treatment process, so that the ultra-copper-containing, high-strength and high-toughness, rapidly degradable magnesium alloy, with controllable tensile strength of 150 MPa-450 MPa, and the corrosion rate that can be up to 3000 mm/a, can be prepared.

In a third aspect, the present disclosure provides use of magnesium alloy in a fracturing ball. The fracturing ball can be prepared using the magnesium alloy provided in the present disclosure, and the fracturing ball made from the magnesium alloy has the advantages of high strength, good toughness and high degradation rate.

In a fourth aspect, the present disclosure provides use of magnesium alloy in oil and gas exploitation. The fracturing ball can be prepared using the magnesium alloy provided in the present disclosure, and the fracturing ball can be used in oil and gas exploitation. As the fracturing ball has the advantages of high strength, good toughness and rapid degradation, the construction process can be reduced, the construction period can be shortened, the construction efficiency can be improved, and the construction cost and risk can be reduced.

The present disclosure will be further described in detail below in connection with examples and comparative examples.

Examples 1-7

Examples 1-7 are directed to a magnesium alloy, respectively, and the elemental composition in each example is listed in Table 1, in percentage by weight.

Comparative Examples 1-4

Comparative Examples 1-4 are directed to a magnesium alloy, respectively, and the elemental composition in each comparative example is listed in Table 1 in percentage by weight.

TABLE 1

Elemental Composition in Each Example and Each Comparative Example

| Serial No. | Alloy Components and State | Volume Fraction of $Mg_{12}CuRE$-type Long-period Stacking Ordered Phase | Volume Fraction of $Mg_5RE$ Phase | Volume Fraction of $Mg_2Cu$ Phase |
|---|---|---|---|---|
| Example 1 | Mg—2.2Cu—0.99Mn—1.48Zn—0.52Y (as-extruded) | 10.50% | 3% | 12% |
| Example 2 | Mg—2.49Cu—4.63Y (as-extruded) | 17% | 4% | 6% |
| Example 3 | Mg—4.2Cu—1Y—4Gd—5Er—0.5Ni (as-extruded) | 22% | 3.8% | 8% |
| Example 4 | Mg—7.0Cu—4Y—5Gd—5Er—0.5Zn—0.8Zr (as-extruded) | 35% | 3.5% | 10% |
| Example 5 | Mg—2.0Cu—16.5Gd (as-extruded) | 10% | 16% | 3% |
| Example 6 | Mg—2.5Cu—8.9Er (as-extruded) | 12% | 7.5% | 5% |
| Example 7 | Mg—6.5Cu—2.5Y—0.8Zr (as-extruded) | 33% | 3.2% | 14% |
| Comparative Example 1 | Mg—0.8Cu—4.5Y (as-extruded) | 3.8% | 7% | 2% |
| Comparative Example 2 | Mg—10.2Cu—15Y (as-extruded) | 65% | 6.5% | 8% |

TABLE 1-continued

Elemental Composition in Each Example and Each Comparative Example

| Serial No. | Alloy Components and State | Volume Fraction of $Mg_{12}CuRE$-type Long-period Stacking Ordered Phase | Volume Fraction of $Mg_5RE$ Phase | Volume Fraction of $Mg_2Cu$ Phase |
|---|---|---|---|---|
| Comparative Example 3 | Mg—0.7Cu—3Er (as-extruded) | 3.3% | 4% | 2% |
| Comparative Example 4 | Mg—11Cu—10Gd—5Er—1Y—0.2Ni (as-extruded) | 72% | 5% | 8% |

Example 8

The present example is directed to a method for preparing the magnesium alloy in Example 1, wherein the magnesium alloy is prepared using a smelting and casting method, and the preparation method includes the following steps:

a) blending raw materials according to formulation: accurately blending the raw materials according to composition formulation of the magnesium alloy in Example 1;

b) smelting: smelting using a resistance furnace or a line frequency induction furnace, wherein argon is used as a protective gas in the smelting process for protection, increasing the temperature to 750° C. and maintaining the temperature, stirring the raw materials by electromagnetic induction so that components are homogeneous and raw materials are melt sufficiently, after the raw materials are melt completely, reducing the temperature to 640° C., standing and maintaining the temperature for 22 min, and taking out the resultant to undergo salt bath water cooling to obtain an alloy ingot;

c) homogenization, extrusion and aging heat treatment: performing the homogenization treatment at 435° C. while maintaining the temperature for 14 h, then performing extrusion deformation treatment at 435° C. and an extrusion ratio of 11, and then performing aging heat treatment at 190° C. while maintaining the temperature for 35 h, and taking the resultant out of the furnace and air cooling the same to room temperature; and d) processing the alloy ingot into a fracturing ball using a conventional processing process to obtain the copper-containing, high-strength and high-toughness, rapidly degradable magnesium alloy.

Example 9

The present example is directed to a method for preparing the magnesium alloy in Example 2, wherein the magnesium alloy is prepared using a smelting and casting method, and the preparation method includes the following steps:

a) blending raw materials according to formulation: accurately blending the raw materials according to composition formulation of the magnesium alloy in Example 2;

b) smelting: smelting using a resistance furnace or a line frequency induction furnace, wherein argon is used as a protective gas in the smelting process for protection, increasing the temperature to 750° C. and maintaining the temperature, stirring the raw materials by electromagnetic induction so that components are homogeneous and raw materials are melt sufficiently, after the raw materials are melt completely, reducing the temperature to 650° C., standing and maintaining the temperature for 30 min, and taking out the resultant to undergo salt bath water cooling to obtain an alloy ingot;

c) homogenization, extrusion and aging heat treatment: performing the homogenization treatment at 450° C. while maintaining the temperature for 12 h, then performing extrusion deformation treatment at 420° C. and an extrusion ratio of 11, and then performing aging heat treatment at 200° C. while maintaining the temperature for 35 h, and taking the resultant out of the furnace and air cooling the same to room temperature; and d) processing the alloy ingot into a fracturing ball using a conventional processing process to obtain the copper-containing, high-strength and high-toughness, rapidly degradable magnesium alloy.

Example 10

The present example is directed to a method for preparing the magnesium alloy in Example 3, wherein the magnesium alloy is prepared using a smelting and casting method, and the preparation method includes the following steps:

a) blending raw materials according to formulation: accurately blending the raw materials according to composition formulation of the magnesium alloy in Example 3;

b) smelting: smelting using a resistance furnace or a line frequency induction furnace, wherein argon is used as a protective gas in the smelting process for protection, increasing the temperature to 760° C. and maintaining the temperature, stirring the raw materials by electromagnetic induction so that components are homogeneous and raw materials are melt sufficiently, after the raw materials are melt completely, reducing the temperature to 670° C., standing and maintaining the temperature for 40 min, and taking out the resultant to undergo salt bath water cooling to obtain an alloy ingot;

c) homogenization, extrusion and aging heat treatment: performing the homogenization treatment at 420° C. while maintaining the temperature for 16 h, then performing extrusion deformation treatment at 430° C. and an extrusion ratio of 11, and then performing aging heat treatment at 210° C. while maintaining the temperature for 35 h, and taking the resultant out of the furnace and air cooling the same to room temperature; and d) processing the alloy ingot into a fracturing ball using a conventional processing process to obtain the copper-containing, high-strength and high-toughness, rapidly degradable magnesium alloy.

Example 11

The present example is directed to a method for preparing the magnesium alloy in Example 4, wherein the magnesium alloy is prepared using a smelting and casting method, and the preparation method includes the following steps:

a) blending raw materials according to formulation: accurately blending the raw materials according to composition formulation of the magnesium alloy in Example 4;

b) smelting: smelting using a resistance furnace or a line frequency induction furnace, wherein argon is used as a protective gas in the smelting process for protection, increasing the temperature to 760° C. and maintaining the temperature, stirring the raw materials by electromagnetic induction so that components are homogeneous and raw materials are melt sufficiently, after the raw materials are melt completely, reducing the temperature to 650° C., standing and maintaining the temperature for 50 min, and taking out the resultant to undergo salt bath water cooling to obtain an alloy ingot;

c) homogenization, extrusion and aging heat treatment: performing the homogenization treatment at 420° C. while maintaining the temperature for 20 h, then performing extrusion deformation treatment at 400° C. and an extrusion ratio of 28, and then performing aging heat treatment at 200° C. while maintaining the temperature for 50 h, and taking the resultant out of the furnace and air cooling the same to room temperature; and d) processing the alloy ingot into a fracturing ball using a conventional processing process to obtain the copper-containing, high-strength and high-toughness, rapidly degradable magnesium alloy.

Example 12

The present example is directed to a method for preparing the magnesium alloy in Example 5, wherein the magnesium alloy is prepared using a smelting and casting method, and the preparation method includes the following steps:

a) blending raw materials according to formulation: accurately blending the raw materials according to composition formulation of the magnesium alloy in Example 5;

b) smelting: smelting using a resistance furnace or a line frequency induction furnace, wherein argon is used as a protective gas in the smelting process for protection, increasing the temperature to 760° C. and maintaining the temperature, stirring the raw materials by electromagnetic induction so that components are homogeneous and raw materials are melt sufficiently, after the raw materials are melt completely, reducing the temperature to 650° C., standing and maintaining the temperature for 60 min, and taking out the resultant to undergo salt bath water cooling to obtain an alloy ingot;

c) homogenization, extrusion and aging heat treatment: performing the homogenization treatment at 435° C. while maintaining the temperature for 14 h, then performing extrusion deformation treatment at 435° C. and an extrusion ratio of 11, and then performing aging heat treatment at 250° C. while maintaining the temperature for 20 h, and taking the resultant out of the furnace and air cooling the same to room temperature; and d) processing the alloy ingot into a fracturing ball using a conventional processing process to obtain the copper-containing, high-strength and high-toughness, rapidly degradable magnesium alloy.

Example 13

The present example is directed to a method for preparing the magnesium alloy in Example 6, wherein the magnesium alloy is prepared using a smelting and casting method, and the preparation method includes the following steps:

a) blending raw materials according to formulation: accurately blending the raw materials according to composition formulation of the magnesium alloy in Example 6;

b) smelting: smelting using a resistance furnace or a line frequency induction furnace, wherein argon is used as a protective gas in the smelting process for protection, increasing the temperature to 750° C. and maintaining the temperature, stirring the raw materials by electromagnetic induction so that components are homogeneous and raw materials are melt sufficiently, after the raw materials are melt completely, reducing the temperature to 660° C., standing and maintaining the temperature for 80 min, and taking out the resultant to undergo salt bath water cooling to obtain an alloy ingot;

c) homogenization, extrusion and aging heat treatment: performing the homogenization treatment at 400° C. while maintaining the temperature for 36 h, then performing extrusion deformation treatment at 435° C. and an extrusion ratio of 40, and then performing aging heat treatment at 190° C. while maintaining the temperature for 35 h, and taking the resultant out of the furnace and air cooling the same to room temperature; and d) processing the alloy ingot into a fracturing ball using a conventional processing process to obtain the copper-containing, high-strength and high-toughness, rapidly degradable magnesium alloy.

Example 14

The present example is directed to a method for preparing the magnesium alloy in Example 7, wherein the magnesium alloy is prepared using a smelting and casting method, and the preparation method includes the following steps:

a) blending raw materials according to formulation: accurately blending the raw materials according to composition formulation of the magnesium alloy in Example 7;

b) smelting: smelting using a resistance furnace or a line frequency induction furnace, wherein argon is used as a protective gas in the smelting process for protection, increasing the temperature to 750° C. and maintaining the temperature, stirring the raw materials by electromagnetic induction so that components are homogeneous and raw materials are melt sufficiently, after the raw materials are melt completely, reducing the temperature to 650° C., standing and maintaining the temperature for 80 min, and taking out the resultant to undergo salt bath water cooling to obtain an alloy ingot;

c) homogenization, extrusion and aging heat treatment: performing the homogenization treatment at 400° C. while maintaining the temperature for 20 h, then performing extrusion deformation treatment at 380° C. and an extrusion ratio of 11, and then performing aging heat treatment at 200° C. while maintaining the temperature for 35 h, and taking the resultant out of the furnace and air cooling the same to room temperature; and d) processing the alloy ingot into a fracturing ball using a conventional processing process to obtain the copper-containing, high-strength and high-toughness, rapidly degradable magnesium alloy.

Comparative Example 5

The present comparative example is directed to a method for preparing the magnesium alloy in Comparative Example 1, wherein the magnesium alloy is prepared using a smelting and casting method. Except that the raw materials are different from those in Example 9, other process parameters in this preparation method are the same as those in the preparation method of Example 9.

Comparative Example 6

The present comparative example is directed to a method for preparing the magnesium alloy in Comparative Example 2, wherein the magnesium alloy is prepared using a smelting and casting method. Except that the raw materials are different from those in Example 9, other process parameters in this preparation method are the same as those in the preparation method of Example 9.

Comparative Example 7

The present comparative example is directed to a method for preparing the magnesium alloy in Comparative Example 3, wherein the magnesium alloy is prepared using a smelting and casting method. Except that the raw materials are different from those in Example 13, other process parameters in this preparation method are the same as those in the preparation method of Example 13.

Comparative Example 8

The present comparative example is directed to a method for preparing the magnesium alloy in Comparative Example 4, wherein the magnesium alloy is prepared using a smelting and casting method. Except that the raw materials are different from those in Example 10, other process parameters in this preparation method are the same as those in the preparation method of Example 10.

The magnesium alloys provided in Examples 1-7 and Comparative Examples 1-3 were tested for performances under the same test condition, respectively, and their tensile strength, elongation and corrosion rate were tested, respectively, and test results are shown in Table 2.

TABLE 2

| Test Results | | | | |
|---|---|---|---|---|
| Test Item | Tensile Strength/MPa | Yield Strength/MPa | Elongation/ % | Corrosion Rate/mm/a |
| Example 1 | 315 | 267 | 9% | 851 |
| Example 2 | 285 | 200 | 2.8 | 1032 |
| Example 3 | 362 | 253 | 7.8 | 1532 |
| Example 4 | 432 | 315 | 7.5 | 1983 |
| Example 5 | 241 | 168 | 3.1 | 821 |
| Example 6 | 374 | 315 | 16 | 930 |
| Example 7 | 175 | 130 | 6 | 3000 |
| Comparative Example 1 | 225 | 120 | 19 | 195 |
| Comparative Example 2 | 380 | 300 | Brittle (unusable) | 2700 |
| Comparative Example 3 | 190 | 140 | 21 | 190 |
| Comparative Example 4 | 400 | 300 | Brittle (unusable) | 2650 |

Although the present disclosure has been illustrated and described with specific examples, it should be aware that many other alterations and modifications can be made without departing from the spirit and scope of the present disclosure. Therefore, it means that the attached claims cover all of these changes and modifications within the scope of the present disclosure.

INDUSTRIAL APPLICABILITY

The copper-containing, high-strength and high-toughness, rapidly degradable magnesium alloy provided in the present disclosure takes magnesium as a base material, and by adding the rare-earth metal elements RE and Cu, the magnesium alloy material obtained forms the $Mg_{12}CuRE$-type long-period stacking ordered phase, the $Mg_5RE$ phase and the $Mg_2Cu$ phase, thereby significantly improving the mechanical properties such as strength of the magnesium alloy; the presence of a large amount of Cu-containing intermetallic compound microparticles, such as the $Mg_2Cu$ phase, and the $Mg_{12}CuRE$-type long-period stacking ordered phase, have a very large electronegativity difference with the magnesium matrix, and a large number of micro-batteries are formed, then promoting the degradation of the magnesium alloy material.

The magnesium alloy provided in the present disclosure has been tested to have a tensile strength of up to 150-450 MPa, good elongation, and a corrosion rate of 300 mm/a-3000 mm/a in 3.5 wt. % sodium chloride solution at 93° C. It can be seen therefrom that the magnesium alloy provided in the present disclosure has the characteristics of high strength, high toughness and rapid degradation.

The present disclosure provides a copper-containing, high-strength and high-toughness, rapidly degradable magnesium alloy and a preparation method therefor. The fracturing ball made using the magnesium alloy can alleviate the problems that the fracturing ball has low strength and is not easily degraded in the prior art.

The present disclosure provides the use of the above magnesium alloy in preparing a fracturing ball and use of the magnesium alloy in oil and gas exploitation, wherein the fracturing ball prepared using the above magnesium alloy has the advantages of high strength and rapid degradation, and using the fracturing ball prepared by the magnesium alloy in an oil and gas exploitation process can reduce the construction cost and risk, shorten the construction period, and improve the construction efficiency.

What is claimed is:

1. A copper-containing degradable magnesium alloy, wherein a strengthening phase of the magnesium alloy comprises an $Mg_{12}CuRE$ long-period stacking ordered phase, an $Mg_5RE$ phase and an $Mg_2Cu$ phase, wherein the $Mg_{12}CuRE$ long-period stacking ordered phase has a volume fraction of 3%~60%, the $Mg_5RE$ phase has a volume fraction of 0.5%~20%, and the $Mg_2Cu$ phase has a volume fraction of 0.5%-15%, wherein RE is a rare-earth metal element.

2. The copper-containing degradable magnesium alloy according to claim 1, wherein the magnesium alloy comprises as-cast magnesium alloy, as-extruded magnesium alloy and aged magnesium alloy.

3. The copper-containing degradable magnesium alloy according to claim 1, wherein the volume fraction of the $Mg_{12}CuRE$ long-period stacking ordered phase is 3%, 4.0%, 4.5%, 5.0%, 8%, 10%, 12%, 15%, 18%, 20%, 22%, 25%, 28%, 30%, 32%, 34%, 36%, 38%, 42%, 46%, 50%, 55%, 58% or 60%; the volume fraction of the $Mg_5RE$ phase is 0.5%, 1%, 2%, 5%, 7%, 10%, 12%, 15%, 18% or 20%; the volume fraction of the $Mg_2Cu$ phase is 0.5%, 1%, 2%, 3%, 5%, 6%, 8%, 9%, 10%, 12% or 15%.

4. The copper-containing degradable magnesium alloy according to claim 1, wherein RE is Gd, Y, Er, a combination of Gd and Y, a combination of Gd and Er, a combination of Y and Er, or a combination of Gd, Y and Er.

5. The copper-containing degradable magnesium alloy according to claim 2, wherein the $Mg_xRE_y$ is $Mg_7RE$, $Mg_5RE$, $Mg_{12}RE$ or $Mg_{24}RE_5$; and the volume fraction of the $Mg_xRE_y$ phase is 3%, 5%, 7%, 10%, 12%, 15%, 18%, 20% or 22%.

6. The copper-containing degradable magnesium alloy according to claim 1, wherein the magnesium alloy comprises a following elemental composition in percentage by weight: Cu 1.0%~10%, and RE 1.0%~30%, and a balance comprises Mg and unavoidable impurities.

7. The copper-containing degradable magnesium alloy according to claim 1, wherein the magnesium alloy comprises a following elemental composition in percentage by weight: Cu 1%~9%, and RE 1%~25%, and a balance comprises Mg and unavoidable impurities.

8. The copper-containing degradable magnesium alloy according to claim 1, wherein the magnesium alloy comprises a following elemental composition in percentage by weight: Cu 2%~8%, and RE 2.5%~22%, and a balance comprises Mg and unavoidable impurities.

9. The copper-containing degradable magnesium alloy according to claim 1, wherein the magnesium alloy comprises a following elemental composition in percentage by weight: Cu 1%~6.5%, RE 1%~28%, and M 0.1%~9%, and a balance comprises Mg and unavoidable impurities, wherein the M is an element that is able to be alloyed with magnesium.

10. The copper-containing degradable magnesium alloy according to claim 1, wherein the magnesium alloy comprises a following elemental composition in percentage by weight: Cu 2.0%~6.0%, RE 2.0%~22%, and M 0.1%~8.5%, and a balance comprises Mg and unavoidable impurities, wherein the M is an element that is able to be alloyed with magnesium.

11. The copper-containing degradable magnesium alloy according to claim 6, wherein the M is any one of Zn, Mn, Zr, V, Hf, Nb, Mo, Ti, Ca, Fe and Ni, or a combination of at least two therefrom.

12. A method for preparing the copper-containing degradable magnesium alloy according to claim 1, wherein raw materials are selected according to a final phase composition of the magnesium alloy, to prepare the magnesium alloy.

13. The method according to claim 12, wherein the raw materials are selected according to an elemental composition ratio of the magnesium alloy according to claim 2, and the magnesium alloy is prepared using an alloy preparation process.

14. The method according to claim 12, wherein the alloy preparation process comprises a smelting and casting method or a powder metallurgic method.

15. The method according to claim 14, wherein a smelting process comprises: melting the raw materials at 690~780° C., wherein an inert gas is adopted for protection during a melting process; cooling melted raw materials to 630~700° C. after the raw materials are sufficiently melted; and standing for 20~90 min to complete the smelting; or a magnesium alloy ingot is obtained by casting after the raw materials are smelted, and the magnesium alloy ingot is successively subjected to homogenization treatment and extrusion deformation, and then subjected to spherized molding treatment; or a magnesium alloy ingot is obtained by casting after the raw materials are smelted, and the magnesium alloy ingot is successively subjected to homogenization treatment, extrusion deformation and aging heat treatment, and then subjected to spherized molding treatment; or the magnesium alloy ingot is successively subjected to homogenization treatment, extrusion deformation and spherized molding treatment, and then subjected to aging heat treatment;

wherein the homogenization treatment is performed in a process condition of: being kept at 350° C.~480° C. for 10 h~36 h;

the extrusion deformation is performed in a process condition of temperature of 350° C.~470° C. and an extrusion ratio of 10~40; and the aging heat treatment is performed in a condition of: being kept at 150° C.~250° C. for 20 h~60 h.

16. The copper-containing degradable magnesium alloy according to claim 2, wherein a strengthening phase of the as-cast magnesium alloy comprises an $Mg_{12}CuRE$ long-period stacking ordered phase, an $Mg_5RE$ phase and an $Mg_2Cu$ phase, wherein the $Mg_{12}CuRE$ long-period stacking ordered phase has a volume fraction of 3%~55%, the $Mg_5RE$ phase has a volume fraction of 0.5%~15%, and the $Mg_2Cu$ phase has a volume fraction of 0.5%~8%.

17. The copper-containing degradable magnesium alloy according to claim 2, wherein a strengthening phase of the as-extruded magnesium alloy comprises an $Mg_{12}CuRE$ long-period stacking ordered phase, an $Mg_5RE$ phase and an $Mg_2Cu$ phase, wherein the $Mg_{12}CuRE$ long-period stacking ordered phase has a volume fraction of 4%~60%, the $Mg_5RE$ phase has a volume fraction of 2%~20%, and the $Mg_2Cu$ phase has a volume fraction of 1%~10%.

18. The copper-containing, high strength and high toughness, rapidly degradable magnesium alloy according to claim 2, wherein a strengthening phase of the aged magnesium alloy comprises an $Mg_{12}CuRE$ long-period stacking ordered phase, an $Mg_2Cu$ phase and an $Mg_xRE_y$ phase, wherein the $Mg_{12}CuRE$ long-period stacking ordered phase has a volume fraction of 4%~60%, the $Mg_2Cu$ phase has a volume fraction of 2%~15%, and the $Mg_xRE_y$ phase has a volume fraction of 3%~22%, wherein a value range of x:y is 3:1-12:1.

19. The copper-containing degradable magnesium alloy according to claim 2, wherein RE is one of Gd, Y and Er, or a combination of at least two therefrom.

20. The copper-containing degradable magnesium alloy according to claim 6, wherein the magnesium alloy comprises the following elemental composition in percentage by weight: Cu 1.0%~10%, RE 1.0%~30%, and M 0.03%~10%, and the balance comprises Mg and unavoidable impurities, wherein the M is an element that is able to be alloyed with magnesium.

* * * * *